United States Patent [19]

Reilhac et al.

[11] 4,038,718

[45] Aug. 2, 1977

[54] DOOR HANDLES, NOTABLY FOR VEHICLES

[75] Inventors: André Jean Reilhac; Robert Cherbourg, both of Billancourt, France

[73] Assignee: Regie Nationale des Usines Renault et Automobiles Peugeot, France

[21] Appl. No.: 279,292

[22] Filed: Aug. 10, 1972

[30] Foreign Application Priority Data

Aug. 12, 1971 France ..... 71.29591

[51] Int. Cl.[2] ..... A47G 27/04

[52] U.S. Cl. ..... 16/110 R; 16/115; 292/DIG. 31; 292/36.3

[58] Field of Search ..... 16/110, 115, 126, 171, 16/112, 114 R, 149; 292/DIG. 31, 336.3, 225, 171, 125

[56] References Cited

U.S. PATENT DOCUMENTS

| | | | |
|---|---|---|---|
| 1,636,069 | 7/1927 | Perry | 16/115 |
| 2,117,192 | 5/1938 | McClung | 292/DIG. 31 |
| 2,191,625 | 2/1940 | Rightmyer | 292/DIG. 31 |
| 2,200,810 | 5/1940 | Sengebusch | 16/126 |
| 2,278,534 | 4/1942 | Dickason | 292/DIG. 31 |
| 2,721,750 | 10/1955 | Rudis et al. | 292/DIG. 31 |
| 3,062,033 | 11/1962 | Schmalfeldt | 292/336.3 X |
| 3,098,686 | 7/1963 | Benoit | 312/320 |
| 3,156,756 | 11/1964 | Seaver | 16/171 |
| 3,338,649 | 8/1967 | Stewart | 312/320 X |
| 3,596,955 | 8/1971 | Collel | 292/336.3 |
| 3,605,173 | 9/1971 | Lautenschlager | 16/163 |

FOREIGN PATENT DOCUMENTS

| | | | |
|---|---|---|---|
| 506,614 | 2/1953 | Canada | 292/DIG. 31 |
| 1,940,662 | 2/1971 | Germany | 292/DIG. 31 |
| 18,190 | 10/1881 | Norway | 292/DIG. 31 |

*Primary Examiner*—Roy D. Frazier
*Assistant Examiner*—Peter A. Aschenbrenner
*Attorney, Agent, or Firm*—Stevens, Davis, Miller & Mosher

[57] ABSTRACT

This door handle for automotive vehicle comprises a casing fitting in the door panel structure and an opening tongue pivotally mounted within said casing.

4 Claims, 4 Drawing Figures

DOOR HANDLES, NOTABLY FOR VEHICLES

The present invention relates to automotive door handles and has specific reference to internal door handles of the so-called flush fitting type adapted to minimize the risks of causing injuries to the passengers of the vehicle in case of crash.

The inner door handle according to this invention is disposed in the forward portion of the door panel and incorporated in the door structure.

The present trend in the field of devices for controlling the opening of doors of motor vehicles is towards a certain miniaturization. The effort necessary for opening a vehicle door has been reduced considerably due to the increased flexibility of the door locks, so that only one or two fingers are sufficient for operating the opening lever or handle. Modern door locks comprise a relatively great number of assembled parts including essentially the means for fixing the pivot pins and shafts, a control rod, a return spring, an opening handle, a support secured to the door panel structure before upholstering the door, and an ornamental element for concealing this support after the upholstering operation.

It is the essential object of the structure of the present invention to meet the following requirements:

- Simplicity: It comprises only three main component elements, i.e. a handle, a casing, a rod;
- Shorter assembling time: The complete assembly is fitted in position by using only snap-on means, i.e. without resorting to any fastening members;
- Safety: The fluid-fitting assembly is incorporated in the hollow door panel, and
- Fluid-tightness.

The attached drawing illustrates diagrammatically by way of example a typical form of embodiment of the door handle arrangement of this invention.

Figure 1:
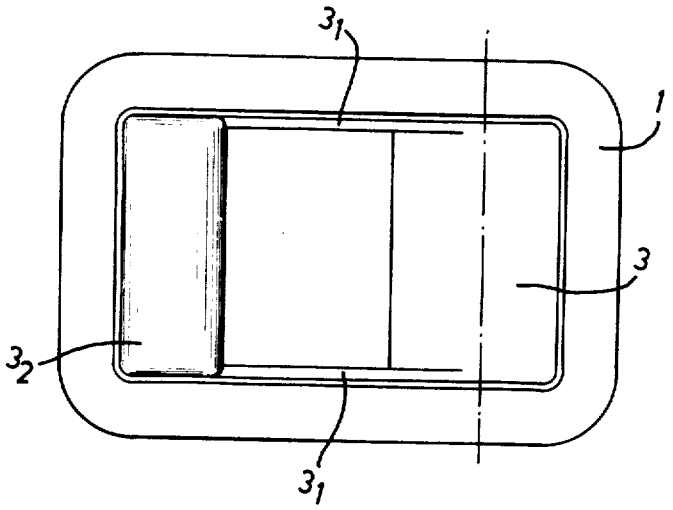
FIG. 1 is a diagrammatic front elevational view of the flush-fitting door handle casing with its opening tongue.
Figure 2:
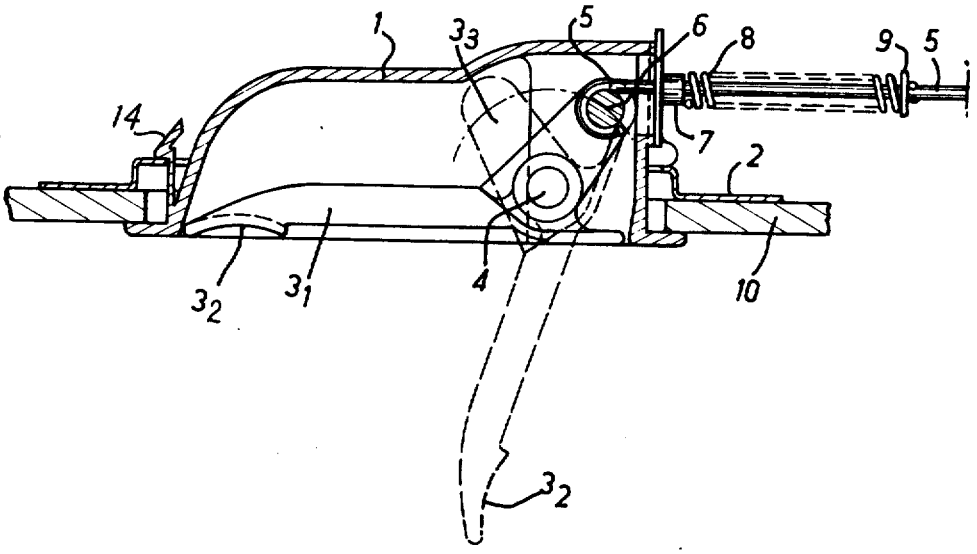
FIG. 2 is a horizontal cross section showing the mounting of the casing in the door panel and the arrangment of the opening tongue in the casing.
Figure 3:
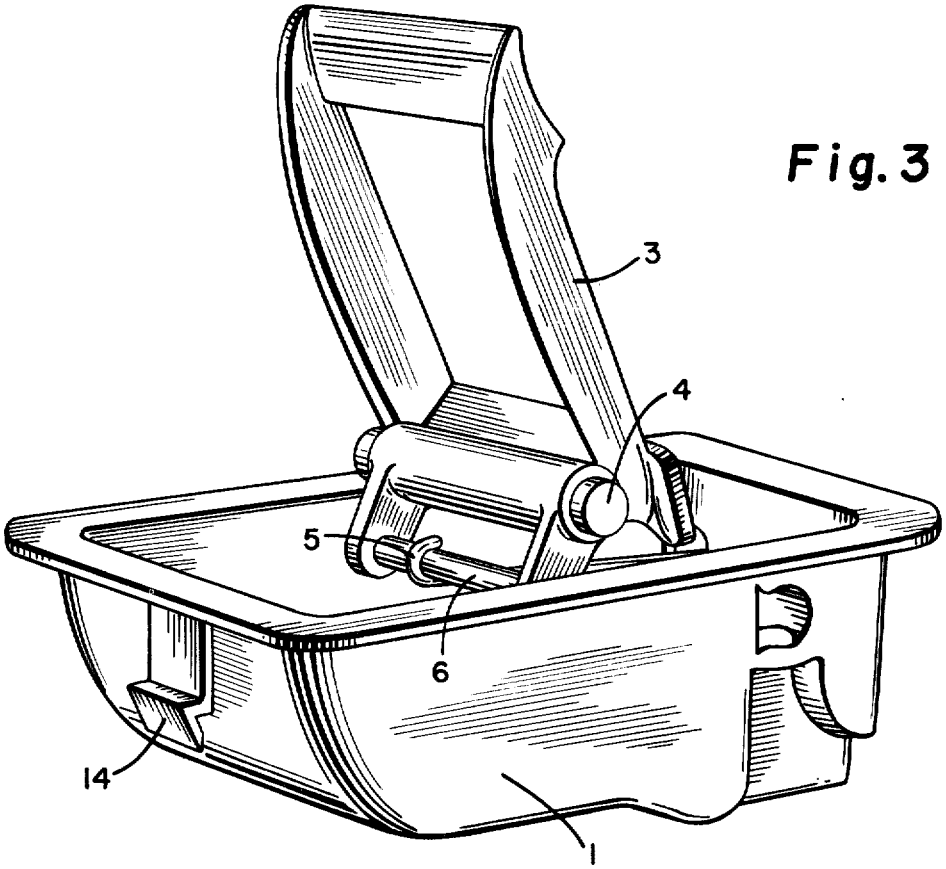
FIG. 3 is a perspective exploded view. The casing is shown with the handle upward and outside of the casing.
Figure 4:
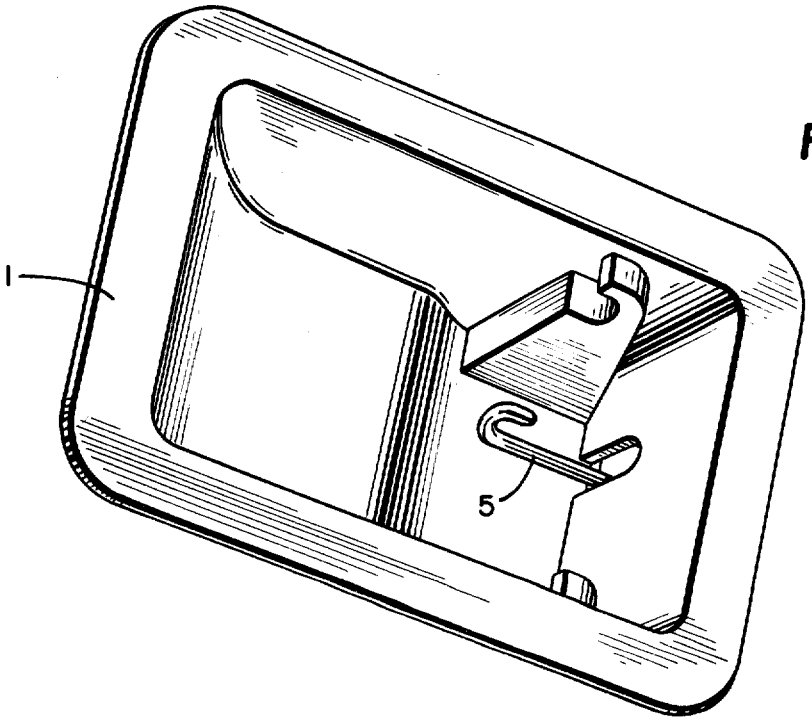
FIG. 4 is a perspective view of the casing showing the rod 5. The traction force exerted by rod 5 tends to oppose the disjointing of the trunnions out from the bearings.

Referring to the drawing, the door handle design according to this invention is particularly simple and comprises essentially a casing 1 positioned and snapped in the door panel structure 2 by snap engaging member 14, and an opening tongue or handle 3 consisting of a two-armed lever pivotally mounted in the casing 1 and comprising a fulcrum pin 4 trunnioned and snapped in position in a bearing 12 of said casing 1. In FIG. 1, the tongue 3 is shown diagrammatically as being connected through a pair of parallel arms $3^1$ to the gripping lug $3^2$. A rod 5 interconnecting the opening tongue 3 and the door lock (not shown) is pivotally mounted by means of a pin 6 carried by the inner and shorter arm $3^3$ of the control handle; this handle is shown in two positions: i.e. the lock opening position (in phantom lines in FIG. 2) in which it projects from the casing 1 and the closed position (in thick lines) in which it is flush with the flange surrounding the casing 1. The control rod 5 is adapted to slide through a sealing grommet 7 bearing freely against the casing 1. A return spring 8 slipped on the rod 5 reacts with one end against said grommet 7 and with the other end against a washer 9 retained by a cross pin on said rod 5.

The reference numeral 10 designates the internal upholstery of the door.

This flush-type door handle assembly is fitted as follows to the door:

Before upholstering the inner surface of the door structure, the lock is mounted therein together with its control rod 5 complete with the return spring 8 and the washer 7 retaining same. Upon completion of the upholstering operation, the casing 1 is engaged through the corresponding aperture and snapped in position in the door structure. The opening tongue 3 is connected to the rod 5 and then inserted into the casing 1 in which it is retained by snap-on elements of conventional type.

Thus, when the opening tongue is operated by pulling same with one or two fingers the rod 5 is moved in the axial direction and actuates the door lock control arm pivoted to the lock plate, the spring 8 constantly urging the assembly to its initial position.

Of course, various modifications may be brought to the specific form of embodiment shown and described herein, without departing from the spirit and scope of the invention as set forth in the appended claims.

I claim:

1. A single unit door handle assembly for snap fastening in the door of a motor vehicle comprising a casing with means adapted to snap said casing in the door panel structure, bearing means provided in said casing, an opening tongue mounted inside said casing with means to engage a control element connected to the door latch, said tongue having integral trunnions for engaging in said bearing means.

2. A door handle assembly according to claim 1 wherein said opening tongue is pivotted in said bearing means provided in said casing and said means to engage a control element comprises a pivot pin on said opening tongue for engagement with the control rod which is connected to the door latch and which is surrounded by a coil compression return spring.

3. A door handle assembly according to claim 1 wherein said opening tongue has a gripping lug connected by a pair of arms.

4. A door handle assembly according to claim 2 wherein said opening tongue has a gripping lug connected by a pair of arms.

* * * * *